US005103602A

United States Patent [19]

Stevens et al.

[11] Patent Number: 5,103,602

[45] Date of Patent: Apr. 14, 1992

[54] BATHTUB AND SHOWER CONSTRUCTION

[76] Inventors: Richard A. Stevens, 4675 Highway 66; Richard L. Vezie, 446 Walker Ave., both of Ashland, Oreg. 97520

[21] Appl. No.: 532,773

[22] Filed: Jun. 4, 1990

[51] Int. Cl.[5] ..... E03C 1/00

[52] U.S. Cl. ..... 52/35; 4/595

[58] Field of Search ..... 52/34, 35, 58, 60, 403; 4/592, 593, 595, 584, 612, 613, 614

[56] References Cited

U.S. PATENT DOCUMENTS 2,526,883 10/1950 LaBarre ..... 4/173
2,528,432 10/1950 Heckathorn .
3,359,574 12/1967 Stoneburner .
3,588,925 6/1971 Kupers et al. .
4,825,480 5/1989 Moore .

*Primary Examiner*—David A. Scherbel
*Assistant Examiner*—Wyhh E. Hood
*Attorney, Agent, or Firm*—Henderson & Sturm

[57] ABSTRACT

A moisture barrier unit (17) to be interposed between a bath fixture (11) such as a tub (11') and an underlayment (13) such as particle board (13') wherein the moisture barrier unit (17) includes: a resilient member (18) which rests on a sub-support (12) such as a subfloor (12') and is compressed between the tub (11') and the particle board (13'); and a waterproof flange member (20) which covers a portion of the block member (18) and the particle board (13') such that the moisture barrier unit (17) will serve to prevent water from contacting either the particle board (13') or the subfloor (12') when the conventional caulk bead (16) becomes cracked.

15 Claims, 2 Drawing Sheets

FIG. 1.
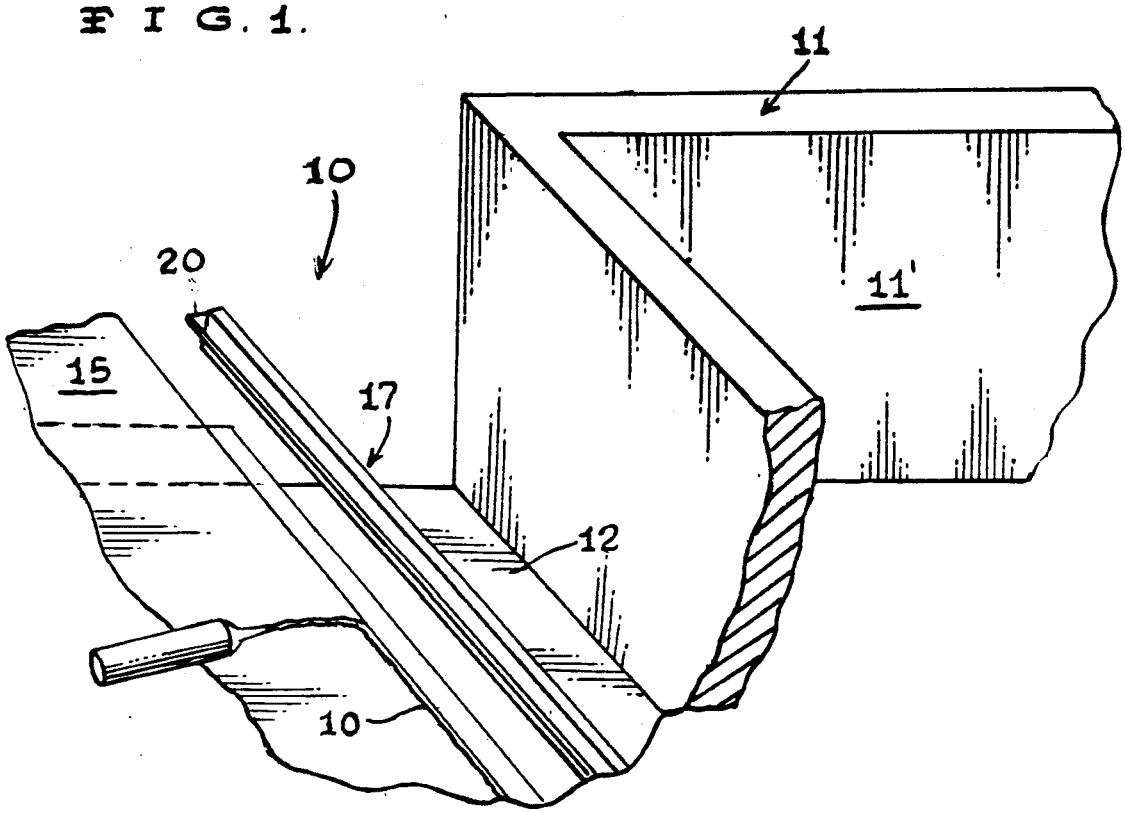
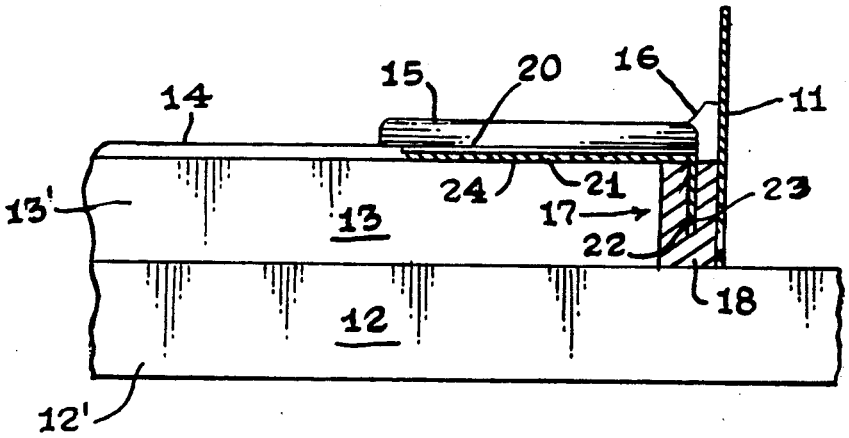
FIG. 2.

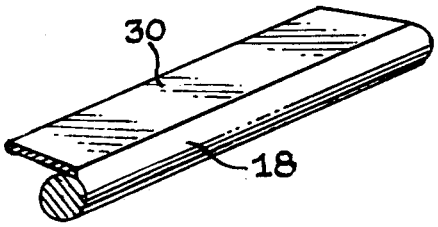
FIG. 3.
FIG. 4.
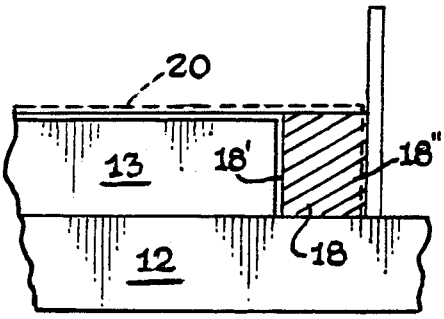
FIG. 5.
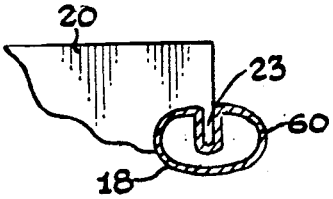
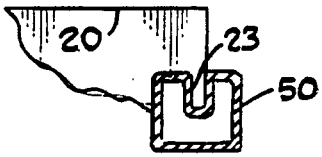
FIG. 6.
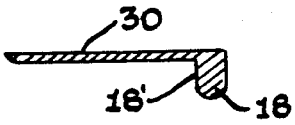
FIG. 8.
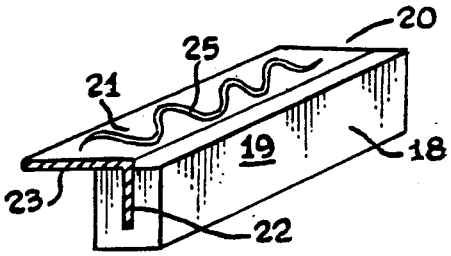
FIG. 7.

BATHTUB AND SHOWER CONSTRUCTION

TECHNICAL FIELD

The present invention relates to the field of bathtub constructions in general, and in particular to bathtub construction that employs a moisture barrier between the tub and the surrounding bathroom structures.

BACKGROUND ART

As can be seen by reference to the following U.S. Pat. Nos. 4,825,480; 3,588,925; 2,528,432; and 3,359,574; the prior art is replete with myriad and diverse bathtub constructions.

While all of the aforementioned prior art constructions are more than adequate for the basic purpose and function for which they have been specifically designed, they do not address the specialized problem of creating a moisture barrier between the tub or shower and its surroundings.

As most home owners or anyone who is familiar with water damage are well aware, the remedying of water damage is a very costly and bothersome task. The primary cause of water damage in the bathroom, specifically around the shower and bathtub area, is due to an insufficient water barrier between the shower or bathtub and its surroundings.

If this water barrier is broken the usual result is dry rot. The most common prior art solutions have employed some type of caulking system to seal the shower or bathtub. Those older sealing methods are usually broken down over time by water and the brittleness associated with the normal aging of the materials employed. As soon as this seal is broken water damage starts occurring and usually by the time the cracks are noticed the damage is extensive.

Therefore there has been a pressing need for a construction that will keep a moisture barrier between the shower and floor or wall even after the seal between the shower and its surrounding structure has been breached. Such a construction should also be easy to install and add little to the overall cost of shower and bathtub constructions.

Based on the foregoing situation, it is obvious that there has existed a longstanding need for an improved shower and bathtub construction among those individuals who have encountered this problem in the past, and the provision of such an arrangement is a stated objective of this invention.

SUMMARY OF THE INVENTION

An object of the present invention is to provide a bathtub and shower construction that will effectively prevent the problem known as dry rot.

Another object of the present invention is to provide a moisture barrier unit that will enable the shower or bath to be physically separated from the wall and/or floor of the bathroom; wherein the construction will maintain a physical barrier between the shower and wall or floor even in the event that the caulking seal is broken around the shower or tub.

Still another object of the present invention is to provide a moisture barrier that has an L-shaped flange that overlaps the underlayment or drywall.

A further object of the present invention is to provide a self adhesive material on the face of the moisture barrier coming in contact with the bathtub or shower.

Yet another object of the present invention is to provide a bathtub and shower construction that is economical to install.

BRIEF DESCRIPTION OF THE DRAWINGS

These and other attributes of the invention will become more clear upon a thorough study of the following description of the best mode for carrying out the invention, particularly when reviewed in conjunction with the drawings, wherein:

FIG. 1 is an exploded view of the bathtub construction;

FIG. 2 is a cross sectional view of the bathtub construction;

FIG. 3 is an isolated perspective view of the moisture barrier unit; and,

FIGS. 8 depict alternate versions of the preferred embodiment.

BEST MODE FOR CARRYING OUT THE INVENTION

As can be seen by reference to the drawings, and in particular to FIG. 1, the bathroom construction that forms the basis of the present invention is designated generally by the reference numeral (10).

As shown in FIGS. 1 and 2 construction comprises a member of conventional bathroom structural components such as a bath fixture (11) such as a tub (11') or a shower (not shown) a sub-support (12) an underlayment (13) such as sheetrock, particle board, plywood, etc., a layer of sealant (14) a surface covering (15) and a bead of caulking (16). In addition the construction further comprises a moisture barrier unit (17) which forms the heart of this invention.

Prior to embarking upon a detailed description of the moisture barrier unit (17) and how it cooperates with the other conventional components of the bathroom construction (10) it should first be noted that the moisture barrier unit (17) can be employed just as easily with a shower (not shown) as with a bathtub (11') wherein the conventional underlayment (13) would comprise sheetrock (13') and wherein a wallcovering would be substituted for the floor covering (15).

As can best be seen by reference to FIGS. 2 and 7 the moisture barrier unit (17) of the preferred embodiment comprises an elongated generally resilient rectangular member (18) a first waterproof block of material (19) such as rubber or the like; and a generally L-shaped flange member (20) formed from a second waterproof material (21) wherein the foot (22) of the flange member (20) is adapted to be received in and be sealingly engaged by a suitably dimensioned groove (23) in the rectangular block (18) and wherein the leg (24) of the flange member (20) is dimensioned to overlie a portion of, and project outwardly a substantial distance from, the top surface of the rectangular block.

In addition the second waterproof material (21) may either comprise a resilient sheet of material (21) such as rubber or the like, or the second waterproof material can comprise a generally rigid yet flexible sheet of material such as sheet metal or the like. Furthermore, the leg (24) of the flange member (20) may also be provided on the top and/or bottom surfaces with a coating of adhesive (25) whose purpose and function will be explained presently.

Turning now to FIGS. 1 and 2 it can be appreciated that the moisture barrier unit (17) is dimensioned and configured to be interposed intermediate most of the conventional structural components associated with a tub or shower and for the purposes of explanation the bathtub (11') of FIGS. 1 and 2 will be used to illustrate this point.

As best shown in FIG. 2 the bottom of the resilient block member (18) is dimensioned to rest proximate the top of the sub-support (12) with the sides of the block member (18) being resiliently compressed between the bathtub (11') and the underlayment (13) wherein the bottom surface of the flange member leg (24) will overlie the top of the underlayment (13) and be optionally sealingly engaged thereto by use of the adhesive strips (25).

A layer of sealant (14) is then placed over the top of the underlayment (13) and the top of the flange leg (24) and the sealant layer (14) is subsequently covered with a conventional floor covering (15') such as tile or linoleum. The final step in the construction involves the application of a caulking strip intermediate the juncture of the moisture barrier unit (17) with both the bathtub (11) and the floor covering (15').

As mentioned previously the moisture barrier unit (17) is designed and intended to provide a waterproof seal beneath the caulk strips (16) and between the bath fixture (11) and the surface covering (15) such that when the caulk seal (16) is cracked or otherwise breached water will not be able to reach either the underlayment (13) or the sub-support (12) thereby virtually eliminating the well recognized phenomenon known as dry rot.

Turning now to FIGS. 3, 4, 5, 6, and 8 it can be seen that this invention also contemplates variations on the generally rectangular configuration of the preferred embodiment depicted in FIGS. 2 and 7. In the variation depicted in FIG. 4, the L-shaped flange member (20) is affixed to either the inboard (18') or outboard (18'') faces of the generally resilient rectangular member (18); wherein, the generally resilient rectangular member (18) is fabricated as a solid rectangular block without benefit of a central groove (23).

In the variation depicted in FIG. 6, the generally resilient rectangular member (18) is fabricated as a hollow member having deformable walls (50) and a central groove (23); wherein, the deformable walls (50) are compressible to closely conform to the space between the underlayment (13) and the bath fixture (11) to form a watertight seal.

In addition in the variation depicted in FIG. 8 the generally resilient rectangular member (18) is fabricated as a solid rectangular member having an integrally formed resilient flap element (30) which projects from the inboard (18') face of the resilient rectangular member (18); wherein, the resilient flap element (30) is substituted for the L-shaped flange member (20) of the preferred embodiment.

In the alternate version of the preferred embodiment depicted in FIGS. 3 and 5, the resilient member (18) is provided with a generally circular configuration; wherein, in FIG. 5, the resilient member (18) is hollow and provided with deformable walls (50) and a central groove (23) for receiving the L-shaped flange member (20); whereas, in FIG. 3 the resilient member (18) is fabricated as a solid cylindrical member having an integrally formed resilient flap element (30) which is substituted for the L-shaped flange member (20).

Having thereby described the subject matter of the present invention, it should be apparent that many substitutions, modifications and variations of the invention are possible in light of the above teachings. It is therefore to be understood that the invention as taught and described herein is only to be limited to the extent of the breadth and scope of the appended claims.

We claim:

1. In a conventional bathroom construction including: a bath fixture, such as a tub; a sub-support, such as a subfloor; an underlayment, to include sheetrock and particle board; a layer of sealant; a surface covering, such as tile; and, a bead of caulking, an improvement comprising:

a moisture barrier unit comprising an elongated generally resilient member having a groove formed in the top surface of said resilient member and a generally L-shaped flange member having a foot which is dimensioned to be engaged in the groove in said resilient member, and a leg which is dimensioned to overlie a portion of and project outwardly a substantial distance from the top surface of said resilient member.

2. The improvement as in claim 1 wherein said resilient member is fabricated from a first waterproof material and said flange member is fabricated from a second waterproof material.

3. The improvement as in claim 1 wherein said first and second waterproof materials comprise different materials.

4. The improvement as in claim 1 wherein said first and second waterproof materials comprise the same material.

5. The improvement as in claim 1 wherein said flange member is fabricated from a resilient sheet of waterproof material.

6. The improvement as in claim 1 wherein said flange member is fabricated from a generally rigid yet flexible sheet of material.

7. The improvement as in claim 1; wherein, said resilient member has a generally rectangular configuration.

8. The improvement as in claim 7; wherein, said resilient member is hollow.

9. The improvement as in claim 1; wherein, said resilient member has a generally cylindrical configuration.

10. The improvement as in claim 9; wherein, said resilient member is hollow.

11. In a conventional bathroom construction including: a bath fixture, such as a tub; a sub-support, such as a subfloor; an underlayment, such as particle board; a layer of sealant; a surface covering, such as tile; and, a bead of caulking, an improvement comprising:

a moisture barrier unit comprising: an elongated resilient member having a top surface, an inboard side and an outboard side; and, a generally L-shaped flange member having a foot which is connected to the resilient member, and a leg which is dimensioned to project outwardly a substantial distance from the top surface of said resilient member.

12. The improvement as in claim 11; wherein, the L-shaped flange member is attached to the inboard side of the resilient member.

13. The improvement as in claim 11; wherein, the L-shaped flange member is attached to the outboard side of the resilient member and the leg is dimensioned to overlie and project a substantial distance beyond the top surface of said resilient member.

14. In a conventional bathroom construction including: a bath fixture such a tub; a sub-support, such as a subfloor; an underlayment, such as sheetrock; a layer of sealant; a surface covering, such as tile; and, a bead of caulking, an improvement comprising:

a moisture barrier unit comprising an elongated generally resilient member having an integrally formed resilient flap element projecting outwardly from the top surface of the resilient member; wherein, said resilient member has an elongated generally rectangular configuration.

15. In a conventional bathroom construction including: a bath fixture, such as a tub; a sub-support, such as a subfloor; an underlayment, such as sheetrock; a layer of sealant; a surface covering, such as tile; and, a bead of caulking, an improvement comprising:

a moisture barrier unit comprising an elongated generally resilient member having an integrally formed resilient flap element projecting outwardly from the top surface of the resilient member; wherein, said resilient member has an elongated generally cylindrical configuration.

* * * * *